US005929409A

United States Patent [19]

Zehnder et al.

[11] Patent Number: 5,929,409

[45] Date of Patent: Jul. 27, 1999

[54] POWER BREAKER

[75] Inventors: Lukas Zehnder, Baden-Dättwil; Robert Anderes, Siebnen; Christian Dähler, Küsnacht; Kurt Kaltenegger, Lengnau; Bodo Brühl, Künten, all of Switzerland

[73] Assignee: Asea Brown Boveri AG, Baden, Switzerland

[21] Appl. No.: 08/825,817

[22] Filed: Apr. 3, 1997

[30] Foreign Application Priority Data

Apr. 4, 1996 [DE] Germany ..... 196 13 568

[51] Int. Cl.[6] ..... H01H 33/18; H01H 33/70

[52] U.S. Cl. ..... 218/48; 218/78

[58] Field of Search ..... 218/8, 11, 12, 218/14, 50, 78, 84, 140, 154, 48, 153, 65

[56] References Cited

U.S. PATENT DOCUMENTS

| | | | |
|---|---|---|---|
| 3,654,409 | 4/1972 | Kessler | 200/48 R |
| 3,909,571 | 9/1975 | Aumayer | 200/148 R |
| 4,009,458 | 2/1977 | Kishi et al. | 200/148 A |
| 4,309,581 | 1/1982 | Macaire et al. | 200/148 A |
| 4,555,603 | 11/1985 | Aoyama | 200/144 |
| 4,665,288 | 5/1987 | Ischi | 200/147 R |
| 5,151,565 | 9/1992 | Perret | 200/148 A |
| 5,521,569 | 5/1996 | Blochouse | 335/147 |

FOREIGN PATENT DOCUMENTS

| | | |
|---|---|---|
| 3219043A1 | 12/1982 | Germany . |
| 3127962A1 | 1/1983 | Germany . |
| 3435967A1 | 3/1986 | Germany . |
| 9107207 U | 9/1991 | Germany . |
| 3915700C2 | 7/1993 | Germany . |
| 4200896A1 | 7/1993 | Germany . |
| 611452 | 5/1979 | Switzerland . |

*Primary Examiner*—Wynn Wood Coggins
*Assistant Examiner*—Michael J. Hayes
*Attorney, Agent, or Firm*—Burns, Doane, Swecker & Mathis, L.L.P.

[57] ABSTRACT

This power breaker has at least one quenching chamber, which is filled with an insulating medium, is of cylindrical design, extends along a central axis (2) and has a power current path, having two stationary consumable contact arrangements (5, 6) which are arranged on the central axis (2), are at a distance from one another in the axial direction and are arranged in the power current path. In the connected state, the consumable contact arrangements (5, 6) are electrically conductively connected by means of a moving bridging contact. An arc zone (24) is provided between the stationary consumable contact arrangements (5, 6). A rated current path, which is provided with moving rated current contacts, is arranged in parallel with the power current path. The bridging contact is arranged in the interior of the consumable contact arrangements (5, 6) extended along the central axis (2).

13 Claims, 3 Drawing Sheets

POWER BREAKER

BACKGROUND OF THE INVENTION

1. Field of the Invention

The present invention relates to a power breaker, and more specifically to a power breaking including a rated current path and a power current path.

2. Discussion of Background

Laid-open specification DE 42 00 896 A1 discloses a power breaker which has a quenching chamber with two stationary consumable contacts which are at a distance from one another. The quenching chamber is filled with an insulating gas, preferably $SF_6$ gas under pressure. When the quenching chamber is in the connected state, the two consumable contacts are electrically conductively connected to one another by means of a moving bridging contact. The bridging contact concentrically surrounds the consumable contacts, which are of cylindrical design. The bridging contact and the two consumable contacts form a power current path, on which current acts only during disconnection. During disconnection, the bridging contact slides down from a first of the consumable contacts and draws an arc which initially burns between the first consumable contact and the end of the bridging contact facing it. As soon as this end reaches the second consumable contact, the arc base commutates from the end of the bridging contact onto the second consumable contact. The arc now burns between the two consumable contacts and is blown until the arc is quenched. The pressurized insulating gas which is required for blowing is, as a rule, produced by means of a blowout piston which is connected to the moving bridging contact.

In addition, this power breaker has a rated current path in parallel with the power current path, which rated current path carries the operational current when the power breaker is switched on. The rated current path is arranged concentrically around the power current path. The bridging contact is in this case mechanically rigidly connected to a moving rated current contact which is arranged in the rated current path. During disconnection, the rated current path is interrupted first, and the current to be interrupted then commutates onto the power current path where, as described above, an arc is then struck and is then quenched.

Because of its dimensions, the bridging contact has a comparatively large mass to be moved, which must be accelerated and braked during switching processes. The power breaker drive has to provide the power required for this purpose.

Laid-open specification DE 31 27 962 A1 discloses a further power breaker which has a quenching chamber with two stationary consumable contacts at a distance from one another. The quenching chamber is filled with an insulating gas, preferably $SF_6$ gas under pressure. When the quenching chamber is in the connected state, the two consumable contacts are electrically conductively connected to one another by means of a moving bridging contact. The bridging contact concentrically surrounds the consumable contacts, which are of cylindrical design. The bridging contact is in this case at the same time designed as a rated current contact. The disconnection process of this power breaker is similar to that for the power breaker described above.

Because of its dimensions, this bridging contact likewise has a comparatively large mass to be moved, which must be accelerated and braked during switching processes. The power breaker drive must provide the power required for this purpose.

SUMMARY OF THE INVENTION

Accordingly, one object of the invention is to provide a power breaker of the type mentioned initially, in which an increase in the speed of the bridging contact is achieved with a comparatively small drive, which requires little energy. In addition, the rated current path of the power breaker is intended to have particularly high long-term strength properties.

Since, in the case of the power breaker according to a first exemplary embodiment of the present invention, the bridging contact is arranged in the interior of the consumable contact arrangement, extended along the central axis, it can be designed with an advantageously small diameter and thus with a particularly low mass. This power breaker can therefore be operated at a comparatively high disconnection speed, since this low-mass bridging contact can be effectively accelerated and reliably decelerated again at the end of the disconnection movement using a comparatively small and advantageously cheap drive.

In addition, the bridging contact is in this case designed as a simple contact pin which has no sprung contact elements and is therefore comparatively simple and cost-effective to produce.

In the case of the power breaker according to a second exemplary embodiment of the present invention, the moving rated current contact is moved significantly slower than the bridging contact which is connected to it via a lever linkage which reduces the speed. The life of the rated current contact is advantageously increased because of the reduced mechanical load, which significantly improves the availability of the power breaker.

In the case of the present power breaker design, the moving rated current contact is accommodated in a volume which is completely separate from the area of the power breaker in which hot gases and erosion particles produced by the arc occur. These hot gases and erosion particles can therefore not have any negative influence on the rated current contacts, as a result of which their long-term properties and thus their life are advantageously increased.

A further advantageous reduction in the cost of the power breaker designs according to the invention results from the fact that the consumable contact arrangements and, to some extent as well, the housing parts, are constructed from identical parts which are arranged in mirror-image symmetry with respect to a plane of symmetry.

The further refinements of the invention are the subject matter of the dependent claims.

The invention, its development and the is advantages which can be achieved thereby will be explained in more detail in the following text with reference to the drawing, which illustrates only one possible means of implementation.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Those elements which are not required for immediate understanding of the invention are not illustrated.

DESCRIPTION OF THE PREFERRED EMBODIMENTS

Figure 1:
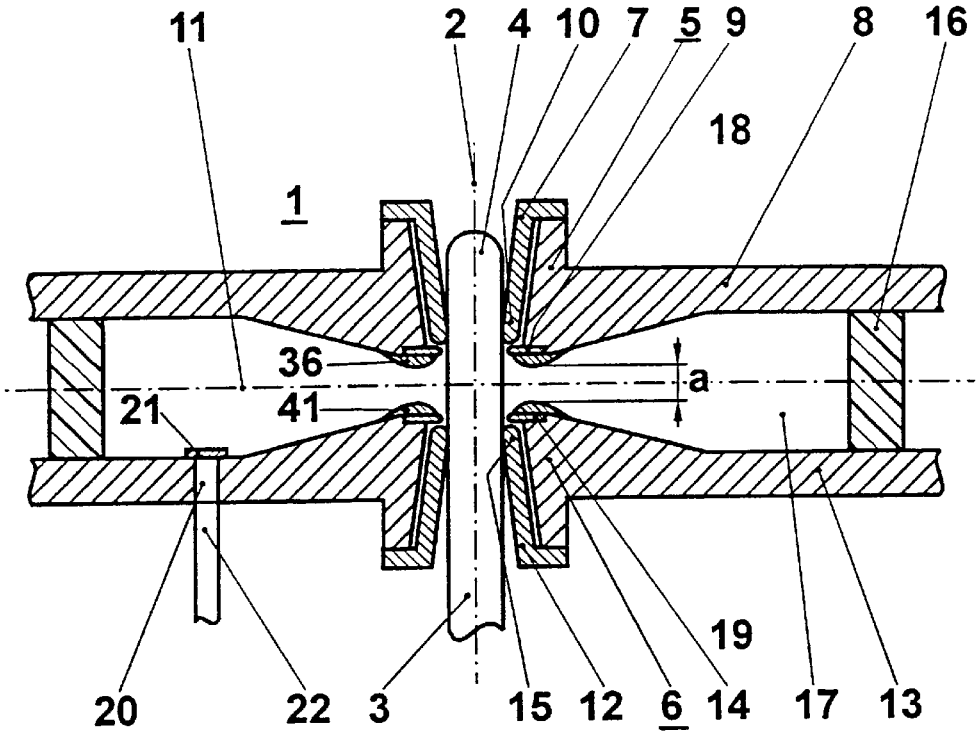
FIG. 1 shows a section through the contact zone of a first embodiment of a power breaker according to the invention in the connected state.

Referring now to the drawings, wherein like reference numerals designate identical or corresponding parts throughout the several views, FIG. 1 shows a schematically illustrated section through the contact zone 1 of the quenching chamber of one embodiment of a power breaker according to the invention in the connected state. The quenching chamber is arranged centrally, symmetrically about a central axis 2. A metallic contact pin 3 extends along this central axis 2, which contact pin 3 is of cylindrical design and can be moved along the central axis 2 by means of a drive, which is not illustrated. The contact pin 3 has a dielectrically favorably shaped tip 4 which, if required, can be provided with an electrically conductive, erosion-resistant material. In the connected state, the contact pin 3 electrically conductively bridges a distance a between two consumable contact arrangements 5, 6.

The consumable contact arrangement 5 has a schematically illustrated contact plunger 7 which is electrically conductively connected to a step on a carrier 8 which is designed in the form of a plate and is made of metal. The contact plunger 7 has contact fingers made of metal which rest in a sprung manner on the surface of the contact pin 3. On the side of the carrier 8 facing the consumable contact arrangement 6, a consumable plate 9 had been connected to this carrier 8 using one of the known methods, instead of the short distance between the two consumable contact arrangements 5 and 6, to be precise in such a manner that the ends 10 of the contact fingers are protected against erosion. The consumable plate 9 is preferably manufactured from graphite, but it may also be made of any other electrically conductive, erosion-resistant materials such as tungsten copper compounds, for example. That surface of the consumable plate 9 which faces away from the carrier 8 is protected against any arc influence by means of a cover 36 which is designed as an annular shape and is made of erosion-resistant insulating material. In addition, the cover 36 prevents the arc base migrating too far into the storage volume 17.

The consumable contact arrangement 6 corresponds in design to the consumable contact arrangement 5, but is arranged in mirror-image symmetry with respect to it. A dashed-dotted line 11 indicates the plane of mirror-image symmetry through which the central axis 2 passes at right angles. The consumable contact arrangement 6 has a schematically illustrated contact plunger 12 which is electrically conductively connected to a step on a carrier 13 which is designed in the form of a plate and is made of metal. The contact plunger 12 has contact fingers made of metal, which rest in a sprung manner on the surface of the contact pin 3. On that side of the carrier 13 which faces the consumable contact arrangement 5, a consumable plate 14 has been connected to this carrier 13 using one of the known methods, instead of the very short distance between the two consumable contact arrangements 5 and 6, to be precise such that the ends 15 of the contact fingers are protected against erosion. The consumable plate 14 is preferably manufactured from graphite, but it may also be made of any other electrically conductive, erosion-resistant materials such as tungsten copper compounds, for example. That surface of the consumable plate 14 which faces away from the carrier 13 is protected against any arc influence by means of a cover 41 which is designed in an annular shape and is made of erosion-resistant insulating material. In addition, the cover 41 prevents the arc base migrating too far into the storage volume 17.

An annular separating wall 16, which is arranged concentrically with respect to the central axis 2 and is made of insulating material, is clamped in between the carriers 8 and 13. The carriers 8 and 13 and the separating wall 16 enclose a storage volume 17 which is of annular design and is designed to store the pressurized insulating gas which is provided for blowing out the arc. The carrier 8 represents one end of an evacuation volume 18 which is designed cylindrically and is completely surrounded by metallic walls. The carrier 13 represents one end of an evacuation volume 19 which is designed cylindrically and is completely surrounded by metallic walls. If a rated current path is provided, then, when the power breaker is in the connected state, the moving rated current contacts which are present in this rated current path represents the electrically conductive connection between the metallic walls of the two evacuation volumes 18 and 19. In this case, only comparatively small stray currents flow through the contact pin 3.

The carrier 13 is provided with a hole 20 which is closed by a schematically illustrated check valve 21. A line 22 is connected to the hole 20 and carries the insulating gas to the storage volume 17, said insulating gas having been compressed during a disconnection process by a piston-cylinder arrangement which is operatively connected to the contact pin 3. However, the pressurized insulating gas can flow into the storage volume 17 only when the pressure in the storage volume 17 is less than in the line 22.

Figure 2:
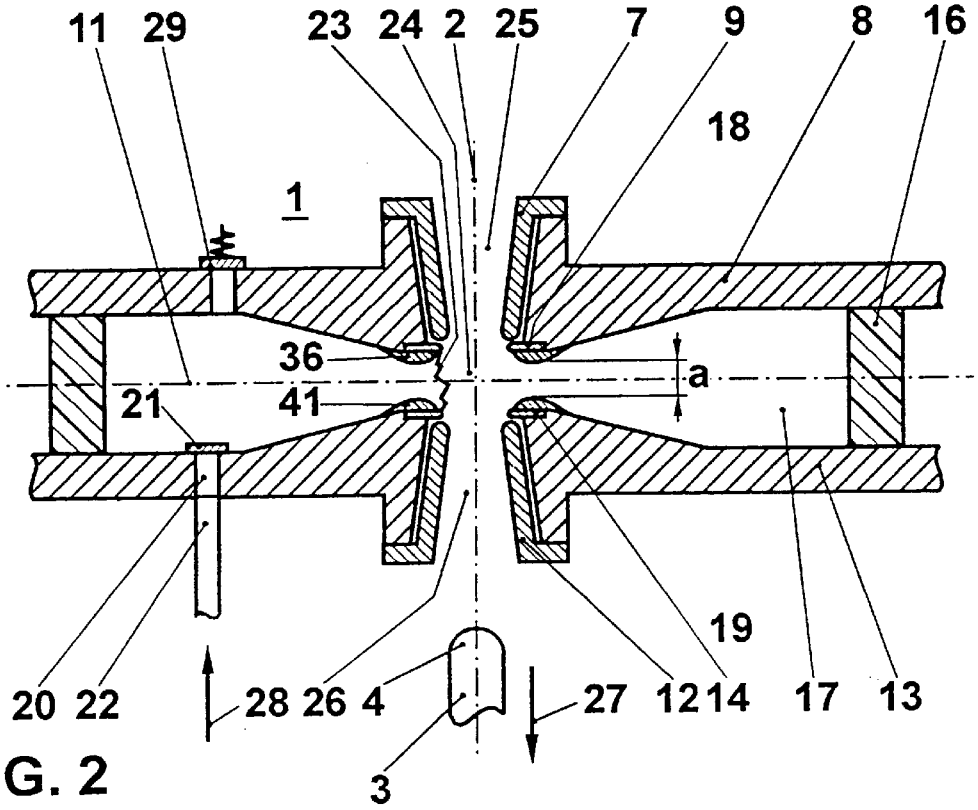
FIG. 2 shows a section through the contact zone of a first embodiment of a power breaker according to the invention during disconnection.

FIG. 2 shows a schematically illustrated section through the contact zone 1 of a first embodiment of the quenching chamber of a power breaker according to the invention during disconnection. The contact pin 3 has drawn an arc 23 between the consumable plates 9 and 14 in the course of its disconnection movement in the direction of the arrow 27. The arc 23 acts thermally on the insulating gas surrounding it and thus briefly increases the pressure in this area of the quenching chamber, which is called the arc zone 24. The pressurized insulating gas is briefly stored in the storage volume 17. Part of the pressurized insulating gas flows, however, on the one hand through an opening 25 into the evacuation volume 18 and, on the other hand, through an opening 26 into the evacuation volume 19.

The contact pin 3 is connected to a piston-cylinder arrangement in which insulating gas is compressed during a disconnection process. As an arrow 28 indicates, this compressed insulating gas is introduced through the line 22 into the storage volume 17 if the pressure in the storage volume 17 is less than in the line 22. For example, this is the case if the current in the arc 23 is so weak that it cannot heat the arc zone 24 intensively enough. However, if a heavy current arc 23 heats the arc zone 24 to a major extent, so that a high pressure occurs in the insulating gas in the storage volume 17, an overpressure valve 29 opens after a predetermined limit has been exceeded, and the excess pressure is dissipated into the evacuation volume 18. Alternatively, it is possible to dispense with the overpressure valve, if the power breaker is designed, for example, only for comparatively small disconnection currents.

Figure 3:
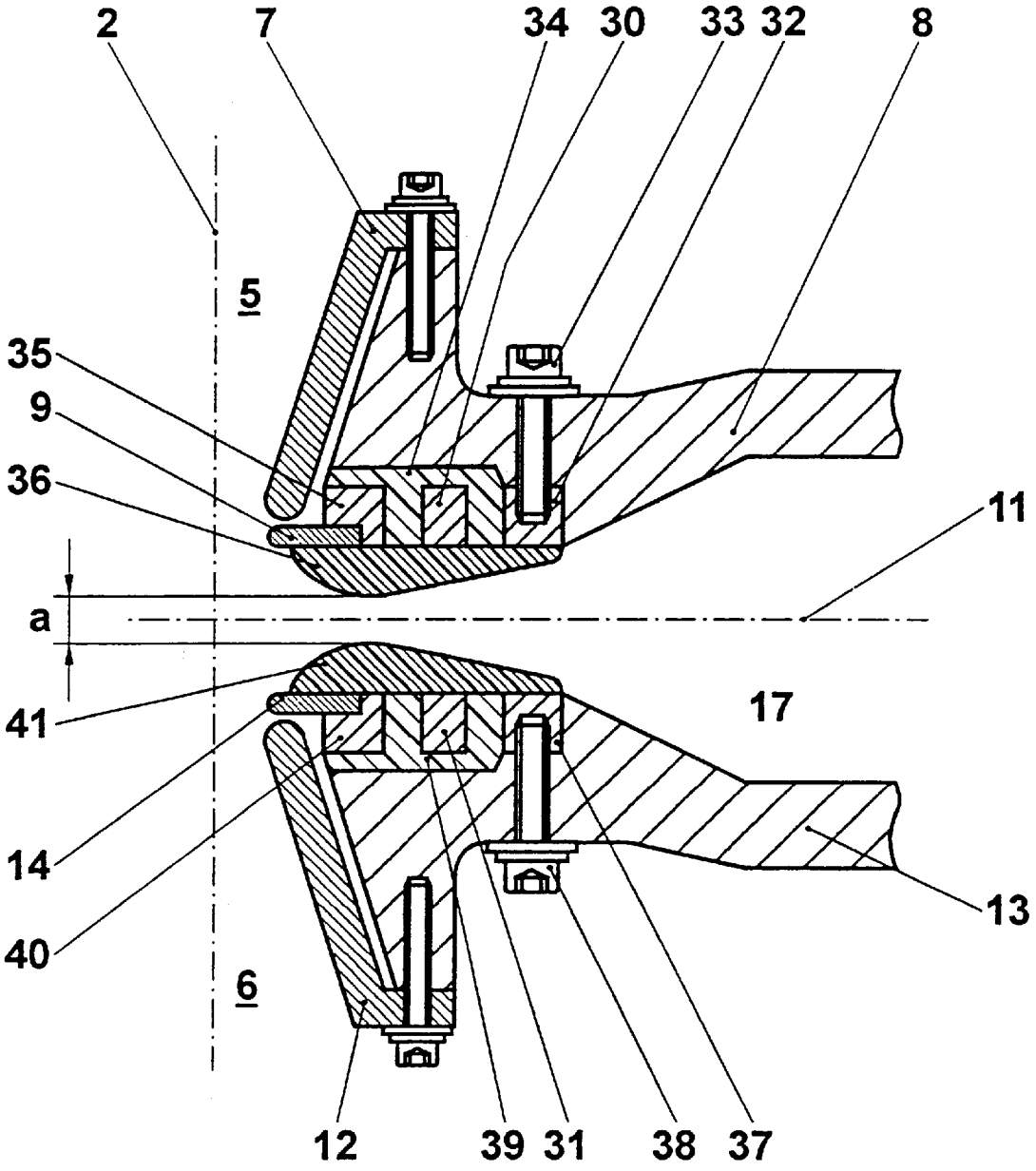
FIG. 3 shows a partial section through the contact zone of a second embodiment of a power breaker according to the invention.

If the arc 23 is caused to rotate about the central axis 2, then, as is known, the heating of the arc zone 24 is thus considerably reinforced. FIG. 3 shows a partial section through a contact zone, which is provided with blowout coils 30 and 31, of a power breaker according to the invention in the disconnected state. The magnetic field of the blowout coils 30 and 31 causes the arc 23 to rotate, in a known manner, during disconnection. The blowout coil 30 is introduced into a depression in the carrier 8, one winding end 32 having a metallically bare contact surface which is pressed by means of a screw 33 against the metallically bare surface of the carrier 8. The winding end 32 is thus electrically conductively connected to the carrier 8. Electrical insulation 34 is provided between the carrier 8 and the rest of the surface of the blowout coil 30 facing the carrier 8. This insulation 34 also spaces the turns of the blowout coil 30 from one another. The other winding end 35 of the blowout coil 30 is electrically conductively connected to the consumable plate 9. That surface of the blowout coil 30 which faces away from the carrier 8, and a part of the surface of the consumable plate 9, are protected against any arc influence by means of a cover 36 made of an erosion-resistant insulating material.

The blowout coil 31 is introduced into a depression in the carrier 13, one winding end 37 having a metallically bare contact surface which is pressed by means of a screw 38 against the metallically bare surface of the carrier 13. The winding end 37 is thus electrically conductively connected to the carrier 13. Electrical insulation 39 is provided between the carrier 13 and the rest of the surface of the blowout coil 31 facing the carrier 13. This insulation 39 also spaces the turns of the blowout coil 31 from one another. The other winding end 40 of the blowout coil 31 is electrically conductively connected to the consumable plate 14. That surface of the blowout coil 31 which faces away from the carrier 13, and a part of the surface of the consumable plate 14, are protected against any arc influence by means of a cover 41 made of an erosion-resistant insulating material.

The two blowout coils 30 and 31 are arranged such that the magnetic fields produced by these blowout coils 30 and 31 reinforce one another. In the case of this embodiment variant, the two covers 36 and 41 form an annular nozzle channel whose constriction has the separation a and expands in the radial direction until it merges into the storage volume 17.

Figure 4:
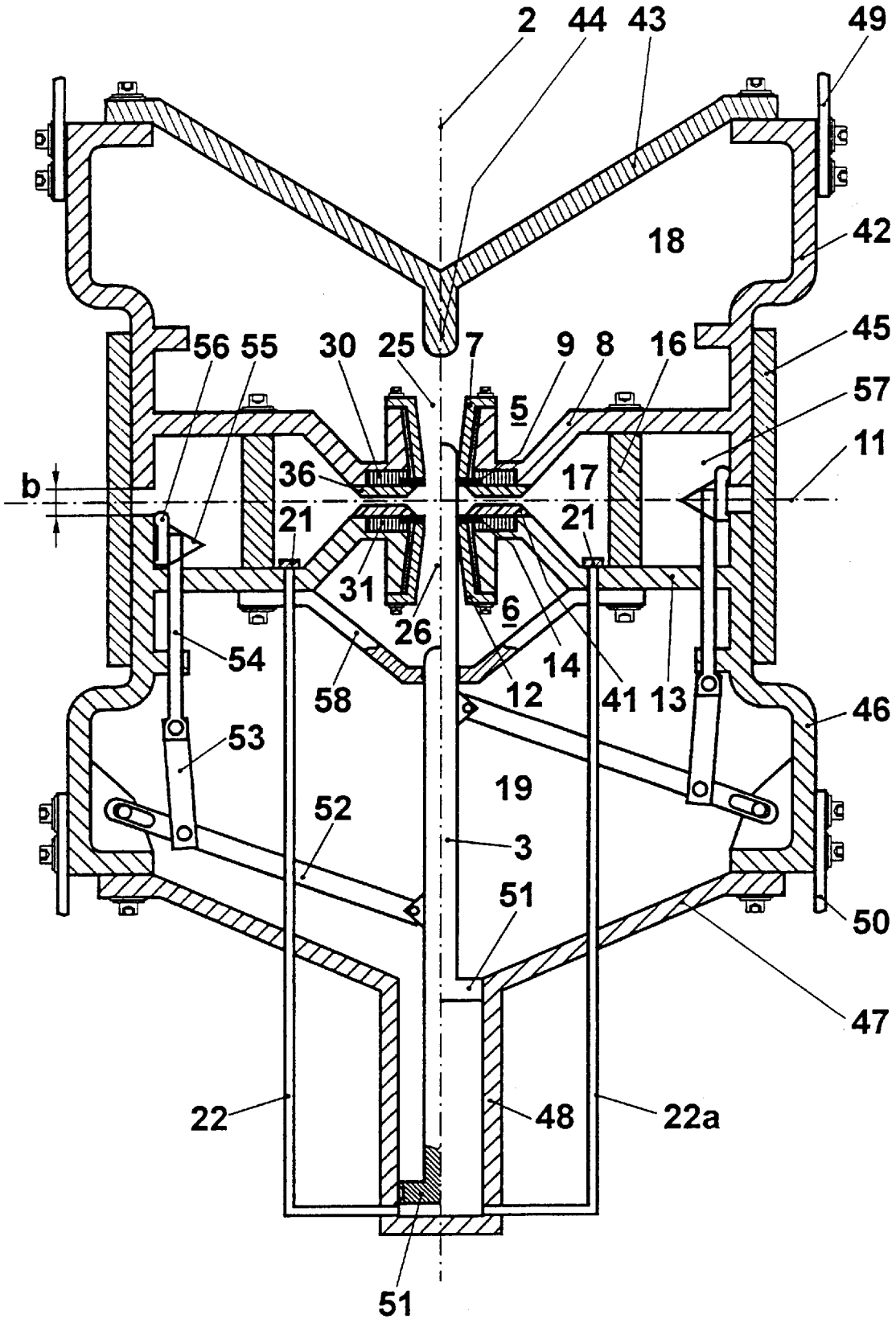
FIG. 4 shows a highly simplified section through a power breaker according to the invention, the power breaker being illustrated in the connected state in the right-hand half of the figure, and the power breaker being illustrated in the disconnected state in the left-hand half of the figure.

FIG. 4 shows a highly simplified section through a schematically illustrated power breaker according to the invention, the power breaker being illustrated in the connected state in the right-hand half of the figure, and the power breaker being illustrated in the disconnected state in the left-hand half of the figure. The power breaker is constructed concentrically around the central axis 2, and its power contacts are provided with blowout coils 30, 31. The evacuation volume 18, which is filled with insulating gas under pressure, preferably $SF_6$ gas, is enclosed by the carrier 8, a cylindrically designed housing wall 42 which is connected to this carrier 8, and a closure cover 43 which is opposite the carrier 8 and is screwed to the housing wall 42 in a pressure-tight manner. The closure cover 43 is provided in the center with a cylindrically designed flow deflector 44 which extends in the direction of the opening 25. As a rule, the housing wall 42 and the closure cover 43 are produced from an electrically highly conductive metal, in the same way as the carrier 8.

The housing wall 42 is connected to a cylindrically designed insulating tube 45 in a pressure-tight manner. The insulating tube 45 is connected, on the side opposite the housing wall 42, in a pressure-tight manner to a further cylindrically designed housing wall 46. The housing wall 46 is designed in precisely the same manner as the housing wall 42, but is arranged in mirror-image symmetry with respect to it, the dashed-dotted line 11 indicating the plane of mirror-image symmetry. The insulating tube 45 is arranged concentrically in respect to the insulating separating wall 16. This housing wall 46 is connected to the carrier 13. The evacuation volume 19, which is filled with insulating gas under pressure, preferably $SF_6$ gas, is enclosed by the carrier 13, the housing wall 46 which is connected to this carrier 13, and a cover 47 which is opposite the carrier 13 and is screwed to the housing wall 46 in a pressure-tight manner. The cover 47 is provided in the center with a cylinder 48. As a rule, the housing wall 46 and the cover 47 are produced from an electrically highly conductive metal, in the same way as the carrier 13. Distance b is provided between the two housing walls 42 and 46. The housing wall 42 is provided on the outside with fastening means for electrical connections 49. The housing wall 46 is provided on the outside with fastening means for electrical connections 50. The insulating tube 45 is arranged in a depression which is formed by the two housing walls 42 and 46, as a result of which the tension forces which are caused by the pressure in the evacuation volumes 18 and 19 and act on the insulating tube 45 in the axial direction are minimized. As a result of this depressed arrangement, the outer surface of the insulating tube 45 is particularly well protected against transportation damages.

A compression piston 51, which is connected to the contact pin 3, slides in the cylinder 48. During the disconnection movement of the contact pin 3, the compression piston 51 seals the insulating gas which is located in the cylinder 48. The compressed insulating gas flows through the schematically illustrated lines 22 and **22*a* into the storage volume 17, if the pressure conditions in this volume allow this. If an excessive compression pressure were to occur in this cylinder 48, then this can be dissipated into the evacuation volume 19** by means of an overpressure valve, which is not illustrated.

The contact pin 3 is moved by a drive, which is not illustrated. At least one lever 52 is hinged on the contact pin 3 and its other end is in this case mounted in the housing wall 46 such that it can rotate and can be displaced. A rocker arm 53 is connected to the lever 52 such that it can rotate, and transmits the force, which is exerted by the lever 52, to a hinged rod 54. The rod 54 is moved parallel to the direction of the central axis 2, and is in this case guided with little friction in the housing wall 46 and in the carrier 13. The other end of the rod 54 is connected to a finger cage 55, which is illustrated schematically as a triangle. The finger cage 55 is used as a holder for a multiplicity of contact fingers 56 which are attached individually in a sprung manner. In order to prevent tilting, at least two such lever linkages are provided for the operation of the finger cage 55, as is illustrated in FIG. 4. In the connected state, the contact fingers 56 form the moving part of the rated current path of the power breaker. The finger cage 55 is illustrated with the power breaker in the connected state in the right-hand part of FIG. 4, the contact fingers 56 bridging the distance b in an electrically conductive manner in this position. The current through the power breaker now flows, for example, from the electrical connections 49, through the housing wall 42, through the contact fingers 56 and the housing wall 46, to the electrical connections 50.

The space 57 in which this moving part of the rated current path is accommodated is highly advantageously completely separated from the arc zone 24 by means of the insulating separating wall 16 and the carriers 8 and 13, so that no erosion particles which are produced in the arc zone 24 can enter the region of the rated current contacts and influence them in a negative manner. The life of the rated current contacts, is thus very advantageously increased, which results in advantageously increased availability of the power breaker.

The lever linkages, which in each case comprise a lever 52, a rocker arm 53 and a rod 54, are designed such that the comparatively high disconnection speed of the contact pin 3 which is produced by the drive, not illustrated, and is in the range from 10 m/s to 20 m/s is converted into a finger cage 55 disconnection speed of about 1 m/s to 2 m/s, which is lower by a factor of about 10. As a result of this slower movement of the finger cage 55, the mechanical stress on it as well as that on the contact fingers 56 is advantageously low, so that these components can be designed to be comparatively light and with low mass since they do not have to withstand any large mechanical stresses. Because of the comparatively low speed, no large mechanical reaction forces act on the contact fingers 56, so that the springs which press the contact fingers 56 against the contact surfaces provided on the housing walls 42 and 46 can be designed to be comparatively weak. The wear on the contact points of the contact fingers 56 and on the contact surfaces on which the contact fingers 56 slide is considerably reduced because of the comparatively low spring forces.

The contact pin 3 is guided on the one hand with the aid of the compression piston 51 which slides in the cylinder 48, and on the other hand in a guide part 58. The guide part 58 is connected to the carrier 13 by means of ribs which are arranged in a star shape.

In all three of the described embodiments of the power contacts of the power breaker, the contact elements are each designed as identical parts. The use of identical parts advantageously reduces the production costs of the power breaker and, in addition, simplifies the storage for its spares.

The figures will be considered in somewhat more detail in order to explain the method of operation. During disconnection, the contact pin 3 draws an arc 23 between the consumable plates 9 and 14 in the course of its disconnection movement. The contact pin 3 is moved at a comparatively very high disconnection speed, so that the arc 23 burns only briefly on the tip 4 of the contact pin 3 and then commutates onto the consumable plate 14. The tip 4 therefore exhibits scarcely any traces of erosion. The consumable plates 9 and 14 are made of particularly erosion-resistant material and they therefore have a comparatively long life. The power breaker therefore need be inspected only comparatively rarely, as a result of which said power breaker has comparatively high availability.

Because of the very fast disconnection movement of the contact pin 3, the arc 23 will reach its full length comparatively quickly, so that, even very shortly after contact separation, all the arc energy is available for pressurizing the insulating gas in the arc zone 24. The arc 23 acts thermally on the insulating gas surrounding it and thus briefly inceases the pressure in the arc zone 24 of the quenching chamber. The pressurized insulating gas is briefly stored in the storage volume 17. However, some of the pressurized insulating gas flows on the one hand through an opening 25 into the evacuation volume 18, and on the other hand through an opening 26 into the evacuation volume 19. As a rule, however, the contact pin 3 is connected to a piston-cylinder arrangement, in which insulating gas is compressed during a disconnection process. This compressed insulating gas is introduced through the line 22 into the storage volume 17, in addition to the thermally produced pressurized insulating gas.

However, this inward flow takes place only if the pressure in the storage volume 17 is lower than in the line 22. This is the case, for example, before contact separation or when the current in the arc 23 is so weak that it cannot heat the arc zone 24 sufficiently intensively. However, if a high-current arc 23 heats the arc zone 24 very intensely, so that a comparatively high insulating gas pressure occurs in the storage volume 17, then the compressed gas produced in the piston-cylinder arrangement does not initially flow inwards at this high pressure. If a predetermined stored pressure limit is exceeded in the storage volume 17, then an overpressure valve 29 opens after this predetermined limit has been exceeded, and the excess pressure is dissipated into the evacuation volume 18. This provides a high level of certainty that the mechanical load capacity of the structural elements cannot be unacceptably exceeded in this area.

As long as there is an overpressure in the arc zone 24, very hot ionized gas also flows away through the openings 25 and 26 into the evacuation volumes 18 and 19. With regard to the structural design of these two flow areas, care has been taken to ensure that they have been designed to be geometically similar, in order to achieve identical outlet flow conditions in both evacuation volumes 18 and 19. The tip 4 of the contact pin 3 is arranged at the center of the evacuation volume 19 opposite the opening 26 and, together with the ribs on the guide part 57, influences the gas flow in this area. The flow deflector 44 is arranged in the evacuation volume 18 at the point corresponding to the tip 4 opposite the opening 25, and influences the gas flow there in a similar manner. Because the flow areas are of very similar design, the two gas flows are formed in a similar manner, so that the pressure which builds up in the arc zone 24 flows away approximately uniformly and in a controlled manner on both sides, as a result of which the insulating gas which is present in the storage volume 17 for quenching the arc 23 can be stored under pressure until it is possible to blow out the arc 23.

The power breaker according to the invention is particularly well suited for switchgear in the medium-voltage range. The compact cylindrical design of the power breaker is particularly suitable for installation in metal-encapsulated systems, in particular for installation in metal-encapsulated generator output lines as well. In addition, the power breaker is very well suited for replacement of obsolete power breakers since, for the same or an improved breaking capacity, it has a considerably smaller space requirement than them and, as a rule, no costly structural changes are required for such a conversion. If it is intended to use the power breaker for operational voltages above about 24 kV to 30 kV, then the distances a and b must be increased and must be matched to the required voltage, and the disconnection speed of the contact pin 3 must also be appropriately adapted, if necessary, that is to say it must be increased.

The connection speed of the contact pin 3 in this power breaker is in the range 5 m/s to 10 m/s, while the contact fingers 56 of the rated current contact move to their connected position at a connection speed in the range from 0.5 m/s to 1 m/s.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A power breaker comprising:

at least one cylindrical quenching chamber filled with an insulating medium and extending along a central axis, said at least one quenching chamber having a power current path and two stationary consumable contact arrangements, said two contact arrangements arranged on said central axis at a distance from one another and in said power current path;

a moving bridging contact which electrically conductively connects the consumable contact arrangements when in a connected state, said quenching chamber having an arc zone provided between said stationary consumable contact arrangements; and a rated current path arranged in parallel with said power current path and provided with moving rated current contacts;

wherein said bridging contact is arranged in the interior of the consumable contact arrangement along said central axis;

wherein said consumable contact arrangements each have openings on sides facing away from said arc zone for ionized gases to flow out of said arc zone in a controlled manner into respectively adjacent evacuation volumes.

2. The power breaker as claimed in claim 1, wherein the moving rated current contacts are connected via at least one lever linkage to the bridging contact; and wherein said at least one lever linkage is of a length and connected to said moving rated current contacts and said bridging contact at positions such that the rated current contacts always move at a slower speed than the bridging contact when said bridging contact is moved along said central axis.

3. A power breaker comprising:

at least one cylindrical quenching chamber filled with an insulating medium and extending along a central axis, said at least one quenching chamber having a power current path and two stationary consumable contact arrangements, said two contact arrangements arranged on said central axis at a distance from one another and in said power current path;

a moving bridging contact which electrically conductively connects the consumable contact arrangements when in a connected state, said quenching chamber having an arc zone provided between said stationary consumable contact arrangements; and a rated current path arranged in parallel with said power current path and provided with moving rated current contacts;

wherein the moving rated current contacts are connected via at least one lever linkage to the bridging contact;

wherein said at least one lever linkage is of a length and connected to said moving rated current contacts and said bridging contact at positions such that the rated current contacts always move at a slower speed than the bridging contact when said bridging contact is moved along said central axis; and wherein said consumable contact arrangements each have openings on sides facing away from said arc zone for ionized gases to flow out of said arc zone in a controlled manner into respectively adjacent evacuation volumes.

4. The power breaker as claimed in claim 3, wherein the bridging contact is arranged in the interior of the consumable contact arrangements and extend along said central axis.

5. The power breaker as claimed in claim 1, wherein the bridging contact is designed as a contact pin.

6. The power breaker as claimed in claim 5, wherein the contact pin is constructed to be driven at a disconnection speed in the range from 10 m/s to 20 m/s.

7. The power breaker as claimed in claim 6, further comprising a space which is completely separated from the arc zone, said moving rated current contacts of the rated current path being arranged in said space.

8. The power breaker as claimed in claim 1, further comprising a nozzle zone arranged between the stationary consumable contact arrangements, designed in an annular shape, and which zone opens into a storage volume designed in an annular shape and bounded by an insulating separating wall.

9. The power breaker as claimed in claim 8, wherein the storage volume is operatively connected to a piston-cylinder arrangement which additionally applies pressure to the insulating medium and is operated by the contact pin.

10. The power breaker as claimed in claim 1, wherein the consumable contact arrangements are designed as identical parts which are arranged in mirror-image symmetry with respect to a plane of symmetry which is arranged at right angles to said central axis.

11. The power breaker as claimed in claim 1, wherein said evacuation volumes are each bounded by walls, a first evacuation volume being enclosed by a first housing wall, a first carrier connected to said first housing wall, and a closure cover (43), and a second evacuation volume being enclosed by a second housing wall, a carrier connected to said housing wall, and a cover, and wherein said first housing wall is connected to said second housing wall by at least one insulating tube, an electrically insulating distance remaining between said two housing walls.

12. The power breaker as claimed in claim 11, further comprising contact fingers which electrically conductively bridge said electrically insulating separation between said first housing wall and said second housing wall;

wherein said first housing wall, said second housing wall, and said contact fingers form said rated current path of the power breaker; and wherein said first housing wall and said second housing wall are designed as identical parts which are arranged in mirror-image symmetry with respect to a plane of symmetry which is arranged at right angles to said central axis.

13. The power breaker as claimed in one of claim 1, wherein said consumable contact arrangements comprise at least one blowout coil.

* * * * *